United States Patent [19]

McGinnis

[11] 4,098,213

[45] Jul. 4, 1978

[54] DUAL-ROLE SKI-ROPE RETRIEVER

[76] Inventor: Lee R. McGinnis, P.O. Box 205, Loami, Ill. 62661

[21] Appl. No.: 673,972

[22] Filed: Apr. 5, 1976

Related U.S. Application Data

[63] Continuation-in-part of Ser. No. 611,358, Sep. 8, 1975.

[51] Int. Cl.[2] ..... B63B 21/00

[52] U.S. Cl. ..... 114/254; 242/86.5 A

[58] Field of Search ..... 114/253, 254, 243; 115/6.1; 242/86.5 A, 85, 85.1, 54 R

[56] References Cited

U.S. PATENT DOCUMENTS

| | | | |
|---|---|---|---|
| 3,215,361 | 11/1965 | Jones, Jr. | 114/235 WS |
| 3,494,570 | 2/1970 | Jones, Jr. | 242/86.5 A |
| 3,498,563 | 3/1970 | Palmieri | 114/235 WS |
| 3,886,888 | 6/1975 | Parsons | 114/235 WS |

*Primary Examiner*—Trygve M. Blix
*Assistant Examiner*—Stuart M. Goldstein
*Attorney, Agent, or Firm*—Ralph F. Staubly

[57] ABSTRACT

The disclosure is a dual-role ski-rope retriever. In its vertical-axis position the reel is rotatable by a geared-down electric motor reversible for paying-out or winding-in the ski rope. The mounting structure also permits the spool to be swung into a horizontally and rearwardly pointed axis position which allows the paying-out of ski rope over and around the rear flange of the spool without its rotation. The rope can be wound-in manually when the spool is restored to its non-rotating detent-held vertical-axis position. The mounting structure is made easily and quickly removable (to discourage theft, vandalism and/or weather damage) by having laterally extending tabs on its flat sheet-metal base, which tabs are longitudinally slidably engageable under laterally positioned cleats fixed to the rear deck of a boat, and by an upwardly springable forwardly extending tongue centrally apertured to fit over a flat support-anchoring disc fixed to the deck.

8 Claims, 9 Drawing Figures

Fig. 1
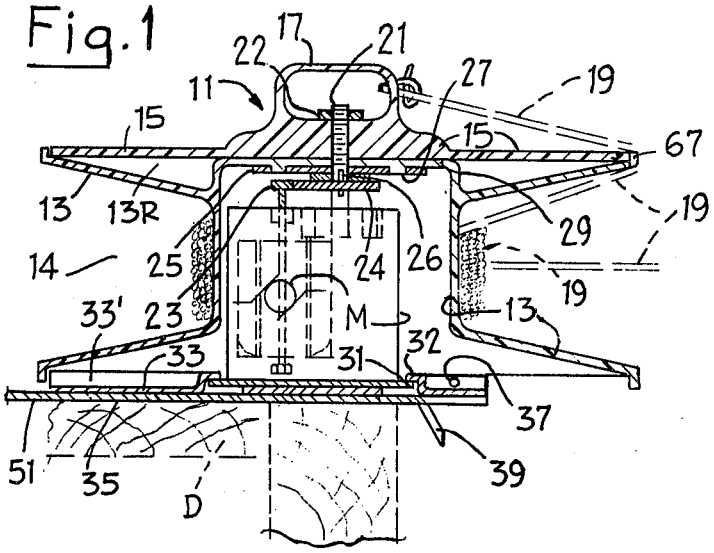
Fig. 8
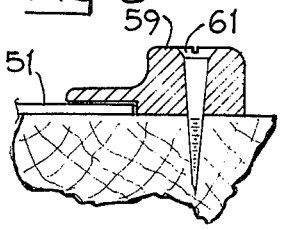
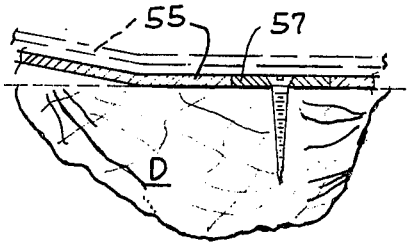
Fig. 7
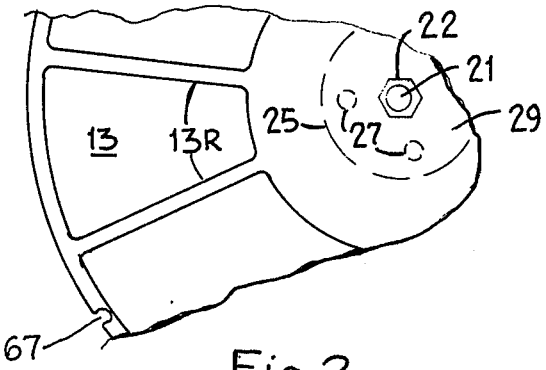
Fig. 2
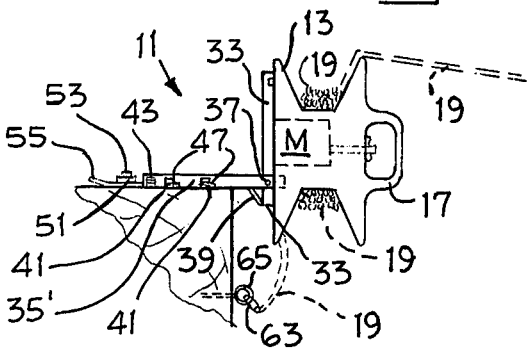
Fig. 9
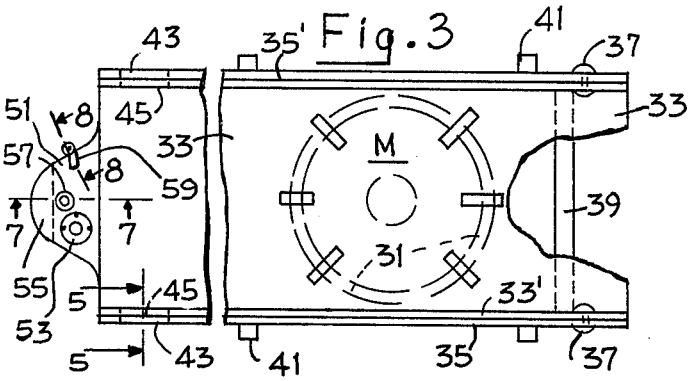
Fig. 3
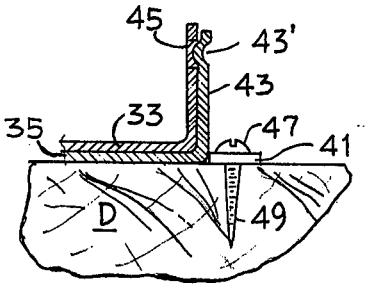
Fig 5
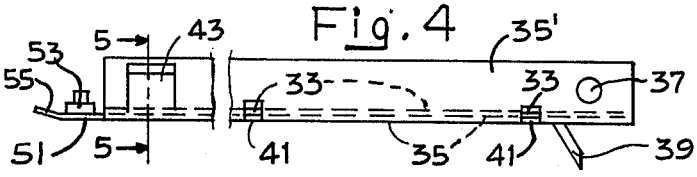
Fig. 4
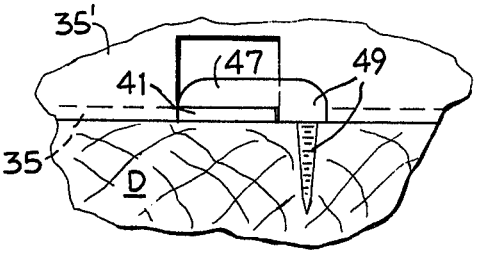
Fig. 6

DUAL-ROLE SKI-ROPE RETRIEVER

DETAILED DESCRIPTION OF THE INVENTION

This application is a continuation-in-part of applicant's copending application Ser. No. 611,358, filed Sept. 8, 1975 and entitled "Non-Rotating Ski-Rope Retriever."

BACKGROUND AND OBJECTS OF THE INVENTION

While motor-driven ski-rope retrievers are broadly old (e.g. Brown, U.S. Pat. No. 3,098,463, 7-23-63) none is known that is easily removable and/or is adapted for use either as a motor-driven, or as a non-rotating manually wound, retriever.

It is accordingly the principal object of this invention to provide a ski-rope retriever adapted for use as a reversible-motor-driven retriever swingable between a vertical-axis position for manual winding-in of rope and a horizontal-axis position for paying-out the rope over and around the edge of the rear spool flange.

It is a further object to provide such a dual-role retriever having means for quickly and easily attaching it to, or detaching it from, a boat deck, for discouraging theft or vandalism and for minimizing weather damage when not in use.

BRIEF DESCRIPTION OF THE DRAWINGS

FIG. 1 is an elevational view of a preferred embodiment of the invention in vertical axial section.

FIG. 2 is a fragmentary plan view of the retriever of FIG. 1 with its cover disc removed.

FIG. 3 is plan view of the two-plate base structure with the motor case shown in phantom.

FIG. 4 is an elevational view of the showing of FIG. 3.

FIG. 5 is an enlarged fragmentary elevational view in section taken on the line 5—5 of FIGS. 3 and 4.

FIG. 6 is an enlarged fragmentary elevational view of the base-to-deck anchoring means of FIG. 5 as seen from the right of FIG. 5.

FIG. 7 is an enlarged fragmentary elevational view in section taken on the line 7—7 of FIG. 3.

FIG. 8 is an enlarged fragmentary elevational view in section taken on the line 8—8 of FIG. 3.

FIG. 9 is a side elevational view of the retriever in its non-rotating paying-out position.

With reference now to the drawings, the numeral 11 generally designates a preferred embodiment of the retriever. Retriever 11 comprises a spool 13 having an inverted cup-shaped hub portion 13' and a toroidal rope-receiving channel 14 of U-shaped cross-section, and preferably die-molded of plastic material or corrosion-resistant metal. The upper flange of spool 13 is covered by a disc 15 of similar material having an integral bail 17 for attachment (e.g. by tying) of ski-rope 19.

The sool 13 and its cover disc 15 are connected to and carried by the drive shaft 21 of a reversible electric motor M (of known construction) by nut 22. The motor M is geared down by the gears 23 and 24 as shown in FIG. 1. Gear 24 and a drive disc 25 are keyed at 26 to the shaft 21. The disc 25 is apertured to drivenly receive the bosses 27 molded on the under surface of the top wall 29 of the spool 13.

The bottom wall of the housing of the motor M is provided with a peripheral flange 31 engageable by tabs 32 initially struck-out from a base plate 33 and then bent down over the flange 31 to fix the motor M and its carried spool 13 to said base plate 33.

The base plate 33 could be the sole support plate if only the motor-driven operation of the retriever were desired. But to incorporate the alternative non-rotating manually wound and automatically payed-out mode of operation (described in detail in applicant's above-noted application) it is desirable to mount the base plate for upward and rearward swinging to the paying-out position shown in FIG. 9. This is accomplished by employing a second base plate 35 underlying the swingable base plate 33 and pivotally connected thereto by pivot rivets 37 passing through aligned apertures in upturned lateral flanges 33' and 35' of the base plates 33 and 35. The under plate 35 has a downwardly bent flange 39 for engagement by the upper plate 33 to arrest the swinging of parts 13 and 33 when they reach their positions of FIG. 9. The two base plates are releasably held in their positions of FIGS. 1, 3 and 4 by detent tongues 43 shaped as shown in FIG. 5 and having their protuberances 43' engaged into cut-out (or depressed) areas 45 in the flanges 33'.

The under plate 35 has tabs 41 struck-out from flanges 35' and adapted to lie flat on the deck D of a boat and to slide rearwardly under the overhanging tongues of the heads 47 of the screw or bolt fasteners 49 (FIGS. 5 and 6).

To quickly and easily detachably fasten the retriever 11 to the deck D, the under plate 35 (or the plate 33 if only one base plate is employed) has a forwardly extending tongue 51, on which may be mounted the three-position motor-reversing switch 53. The tongue 51 has an upwardly angled forward portion 55 for finger engagement to effect a slight upwardly resilient bending of the tongue 51 so as to lift it to the phantom-shown position of FIG. 7, in which position it can be detachably slid over the flat disc 57 which is normally snugly received in an aperture in the tongue 51. The disc 57 and the tab-engaging fasteners 49 are the only elements required to remain fixed to the deck D when the retriever is removed. However, it may be desirable to add for increased safety, a rotatable device 59 (FIG. 8) to prevent the tongue 51 from accidentally rising to the phantom-shown retriever-removing position of FIG. 7. The device is fixed to the deck D by a screw 61.

The upper flange of the spool 13 may be provided with integral rigidifying ribs 13R.

For use of the retriever in the non-rotating arrangement of FIG. 9, the boat end of the rope 19 can be tied, or fastened as by a dog-leash clip 63, to a screw eye 65 fixed to the boat transom.

The edge of the upper flange of the spool 13 may have a rope-diameter notch 67 formed therein (FIGS. 1 and 2) to permit changing from one to the other mode of operation without unwinding and rewinding the rope. The base or mounting structure formed by the plates 33 and 35, interconnected by hinge rivets 37, support the reel member or spool 13 for swinging up from its normal (motor-driven) position of FIG. 1 to the non-rotating rope-paying-out horizontal-axis position of FIG. 9, in which latter position the downturned flange 39 arrests swinging of the short rear extension of the plate 33 shown in phantom in FIG. 1.

Having thus described my invention, I claim:

1. A dual-role ski-rope retriever, comprising: a reel member having an inverted cup-shaped hub portion with upper and lower flanges extending therefrom and an upper disc portion covering the upper flange, the upper and lower flanges defining a radially open annular ski-rope-receiving channel, a reversible motor positioned in said hub portion and having a drive shaft which is vertically disposed when the reel member is in a normally vertical-axis power-driven position, means connecting said reel member to said drive shaft to support and reversibly rotate said reel member, and base structure comprising a first plate attachable flatwise to a horizontally disposed support surface, a second plate hingedly connected to said first plate and swingable from a position overlying said first plate to a vertically disposed position, means arresting the swinging of said second plate in its vertically disposed position, and means fixing said reel member and its motor to said second plate, the retriever being constructed and arranged to permit said reel member to be swung from its normally vertical-axis power-driven position to a rearwardly and horizontally disposed axis position for non-rotatingly paying-out ski rope over and around the upper disc portion of the reel member.

2. Structure according to claim 1, said connecting means comprising an apertured disc fixed to said drive shaft, and protuberances depending from the top wall of said cup-shaped reel portion and being snugly engaged in the apertures in said shaft-fixed disc.

3. Structure according to claim 1 wherein the upper disc portion is clamped to the upper surface of the inverted cup-shaped reel hub portion by a nut threaded onto the upper end of said drive shaft, said upper disc having an upstanding bale for carrying the retriever and for tying a ski-rope thereto.

4. Structure according to claim 1, said base structure comprising at least one horizontally extending base-anchoring tab on each side thereof for lying flatly against a boat deck and said retriever additionally comprising a plurality of anchoring elements having lips adapted to overhang said tabs when slid under said lips, said anchoring elements being adapted for attachment to a boat deck by threaded rods.

5. Structure according to claim 4, said base structure additionally comprising a forwardly extending lip adapted to lie flushly against a boat deck, said lip having a base-anchoring aperture therein, and said retriever additionally comprising an anchoring disc attachable to said boat deck, said lip being sufficiently upwardly flexible to permit forward sliding of said lip over said anchoring disc to disengage said base-anchoring tabs from under said anchoring elements so as to permit quick and easy detachment of said retriever from said deck.

6. Structure according to claim 1, said reel member being molded of a tough somewhat resilient plastic material.

7. Structure according to claim 6 wherein at least the upper disc portion has strengthening radial ribs molded thereon.

8. Structure according to claim 1, the upper disc portion having a rope-diameter notch formed in its periphery.

* * * * *